US006264441B1

(12) United States Patent
Marioni

(10) Patent No.: US 6,264,441 B1
(45) Date of Patent: Jul. 24, 2001

(54) PUMP FOR THE DRAIN OUTLET OF WASHING MACHINES

(75) Inventor: Elio Marioni, Via Caprera (IT)

(73) Assignee: Askoll Tre S.p.A., Dueville (IT)

( * ) Notice: Subject to any disclaimer, the term of this patent is extended or adjusted under 35 U.S.C. 154(b) by 0 days.

(21) Appl. No.: 09/523,980

(22) Filed: Mar. 13, 2000

(30) Foreign Application Priority Data

Mar. 16, 1999 (IT) ..... PD99A0050

(51) Int. Cl.[7] ..... F04B 17/00; F04B 35/04
(52) U.S. Cl. ..... 417/423.1; 134/104.1
(58) Field of Search ..... 417/300, 423.1, 417/360, 423.15; 415/228, 52.1, 121.1, 206; 68/17 R; 8/158; 134/104.1, 88

(56) References Cited

U.S. PATENT DOCUMENTS

| | | | | |
|---|---|---|---|---|
| 3,751,179 | * | 8/1973 | Wassmann | 415/228 |
| 3,851,993 | * | 12/1974 | Foster | 415/52.1 |
| 3,953,146 | * | 4/1976 | Sowards | 415/121.1 |
| 4,243,431 | * | 1/1981 | Dingler et al. | 134/104.1 |
| 4,306,841 | * | 12/1981 | Morrison et al. | 417/360 |
| 4,467,627 | * | 8/1984 | Platt et al. | 68/17 R |
| 4,622,708 | * | 11/1986 | Gaelic | 8/158 |
| 4,972,861 | * | 11/1990 | Milocco et al. | 134/104.1 |
| 4,998,861 | * | 3/1991 | Fukuzawa et al. | 415/206 |
| 5,131,420 | * | 7/1992 | Favret et al. | 134/104.1 |
| 5,320,120 | * | 6/1994 | Hoffmsn et al. | 134/104.1 |
| 5,331,986 | * | 7/1994 | Lim et al. | 134/88 |

FOREIGN PATENT DOCUMENTS

| | | | | |
|---|---|---|---|---|
| 3743709-A1 | * | 7/1989 | (DE) | F06D/9/22 |
| 0326894 | * | 8/1989 | (DE) | F04D/29/22 |
| 1223997 | * | 9/1989 | (JP) | D06F/25/00 |
| 3168195 | * | 7/1991 | (JP) | D06F/39/08 |
| 10146494 | * | 6/1998 | (JP) | D06F/39/08 |
| WO-0029660 | * | 5/2000 | (NZ) | D06F/33/02 |

* cited by examiner

*Primary Examiner*—Teresa Walberg
*Assistant Examiner*—Leonid Fastovsky
(74) *Attorney, Agent, or Firm*—Guido Modiano; Albert Josif; Daniel O'Byrne

(57) ABSTRACT

A pump for the drain outlet of washing machines having a synchronous electric motor with a permanent-magnet rotor which is associated, by a flange, with a dome which forms a chamber for the impeller, further having an impeller with radial vanes which protrude from a perforated disk provided with a plurality of pressure-compensating vanes on a motor side of the disk, a dome which forms the chamber of the impeller, an intake duct which has an elliptical cross-section with a median axis which is parallel to an axis of the impeller but is axially offset on an opposite side with respect to a discharge duct, which also has an elliptical cross-section, with a radiused inlet which has the local internal configuration of the dome.

6 Claims, 4 Drawing Sheets

PUMP FOR THE DRAIN OUTLET OF WASHING MACHINES

BACKGROUND OF THE INVENTION

The present invention relates to an improved pump, particularly for use in the drain outlet of washing machines or the like.

A pump driven by a permanent-magnet synchronous motor is more and more frequently installed in these machines; owing to its characteristics, it certainly achieves the goal of reducing costs and consumption, but it suffers several problems.

In the field of washing machines, manufacturers have developed technical specifications which take into account a wide range of situations, linked in particular to blockages or clogging, or in any case to difficulty in draining.

One of the main problems is linked to the water, which contains detergent foam in an amount which is inversely proportional to the hardness of the water, and to the fact that the user quite often introduces excessive doses of detergent.

The presence of a large amount of foam leads to cavitation of the impeller inside its chamber, with consequent difficulties in draining.

Many technical specifications further require that various types of objects that can be present in the items that are washed must be able to pass through the pump.

For example, socks, sponges of various kinds, metallic coins, hairpins, chains, toothpicks or other objects of this type and size must be able to pass through a drain outlet pump without jamming.

Moreover, lint or threads which are always present in the drain water of a washing machine can coil around the shaft of the motor, blocking it.

SUMMARY OF THE INVENTION

The aim of the present invention is to provide an improved pump which can operate without clogging even in difficult conditions.

Within the scope of this aim, an object of the present invention is to provide a pump which is capable of draining the water of a washing machine even if it contains a considerable amount of foam.

Another object of the present invention is to provide a pump which can expel products of various kinds that are present in the washing water.

Another object of the present invention is to provide a pump in which the motor shaft is protected, preventing string-like products from coiling around it.

Another object of the present invention is to provide a pump which has a good hydraulic performance and accordingly a low electrical power consumption.

This aim, these objects and others which will become apparent hereinafter are achieved by an improved pump for the drain outlet of washing machines, comprising a synchronous permanent-magnet electric motor which is associated, by means of a flange, with a dome which forms a chamber for an impeller, characterized in that it comprises an impeller with is radial vanes which are associated with a perforated disk provided with a plurality of pressure-compensating vanes on a motor side of the disk, a dome which forms the chamber of the impeller, an intake duct which has an elliptical cross-section with a median axis which is parallel to an axis of the impeller but is axially offset on an opposite side with respect to a discharge duct, which also has an elliptical cross-section, with a radiused inlet which has the local internal configuration of said dome.

BRIEF DESCRIPTION OF THE DRAWINGS

Further characteristics and advantages of the present invention will become apparent from the following detailed description of a preferred embodiment thereof, given only by way of non-limitative example and illustrated in the accompanying drawings, wherein.

DESCRIPTION OF THE PREFERRED EMBODIMENTS

Figure 1:
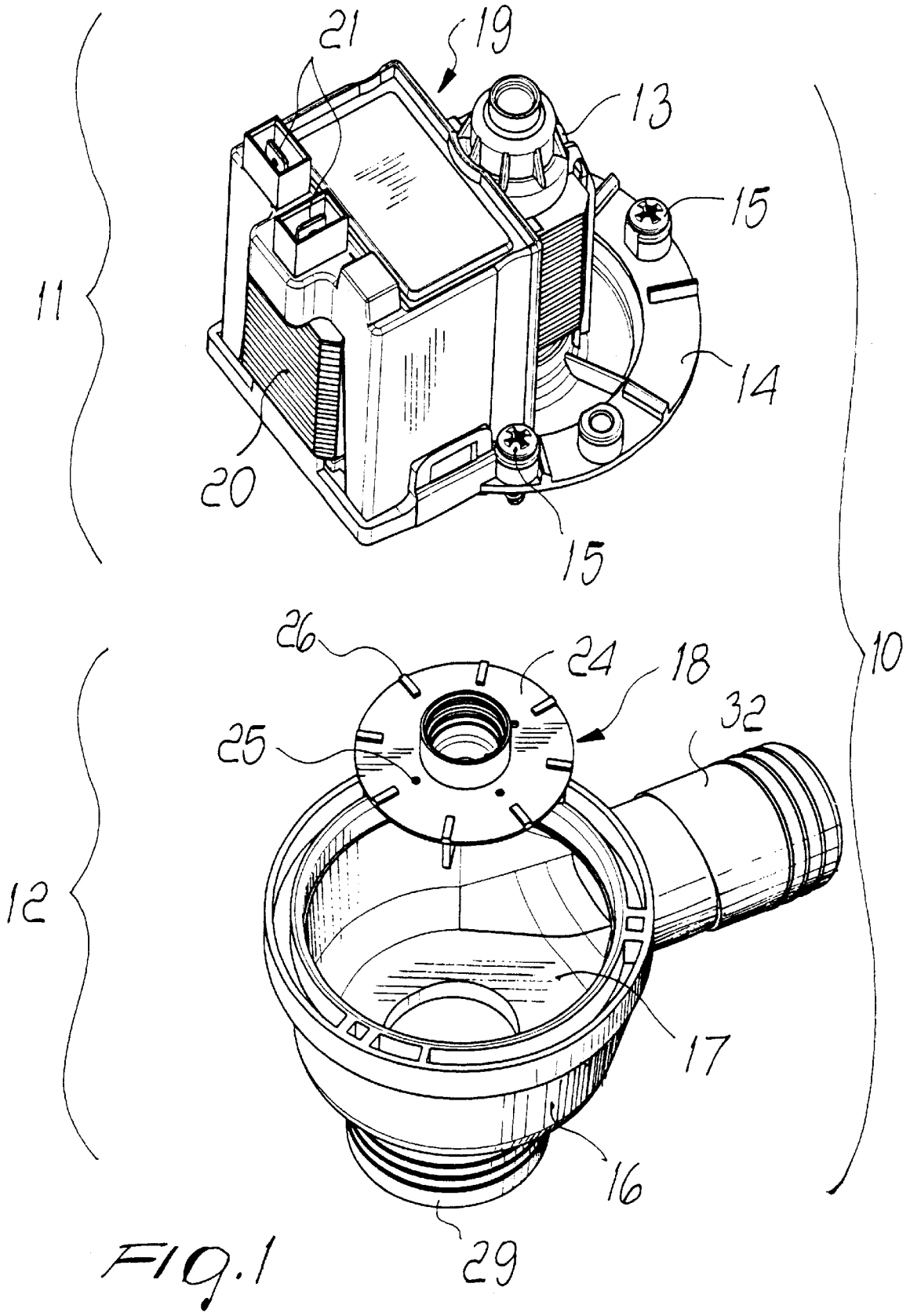
FIG. 1 is an exploded perspective view, from the motor side, of the pump according to the invention.
Figure 2:
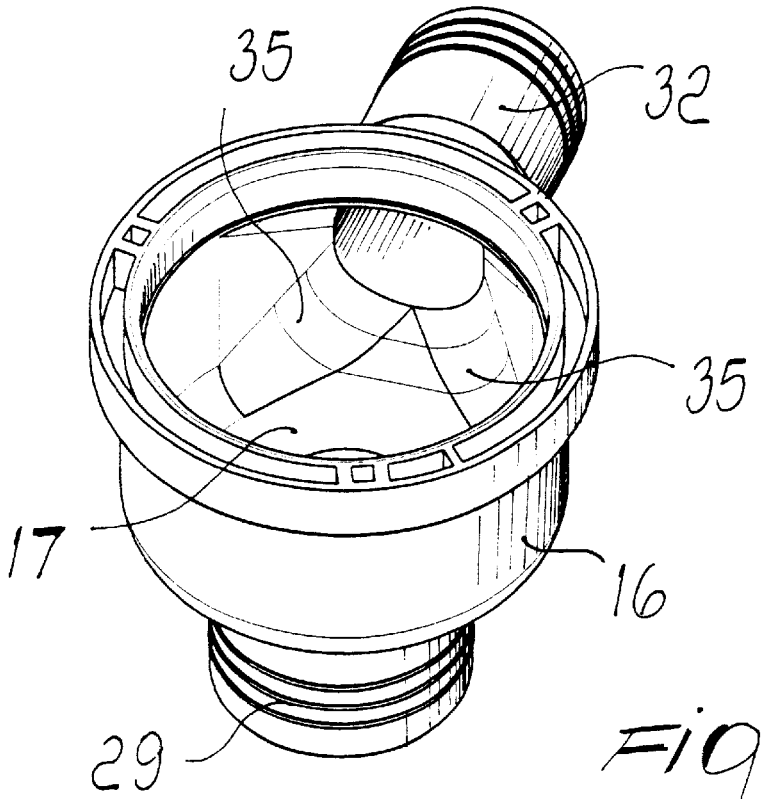
FIG. 2 is a perspective view of the dome of the chamber of the impeller.
Figure 3:
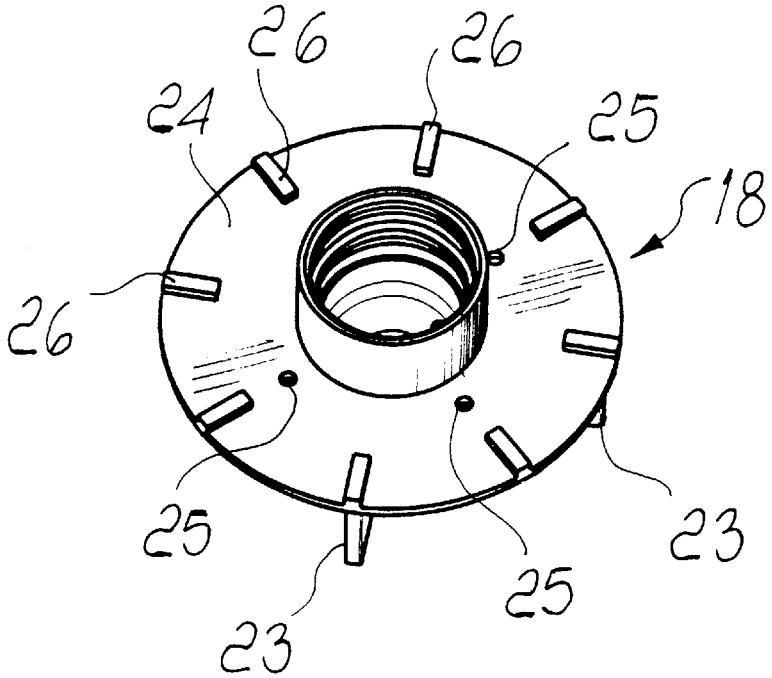
FIG. 3 is a perspective view of the impeller.
Figure 4:
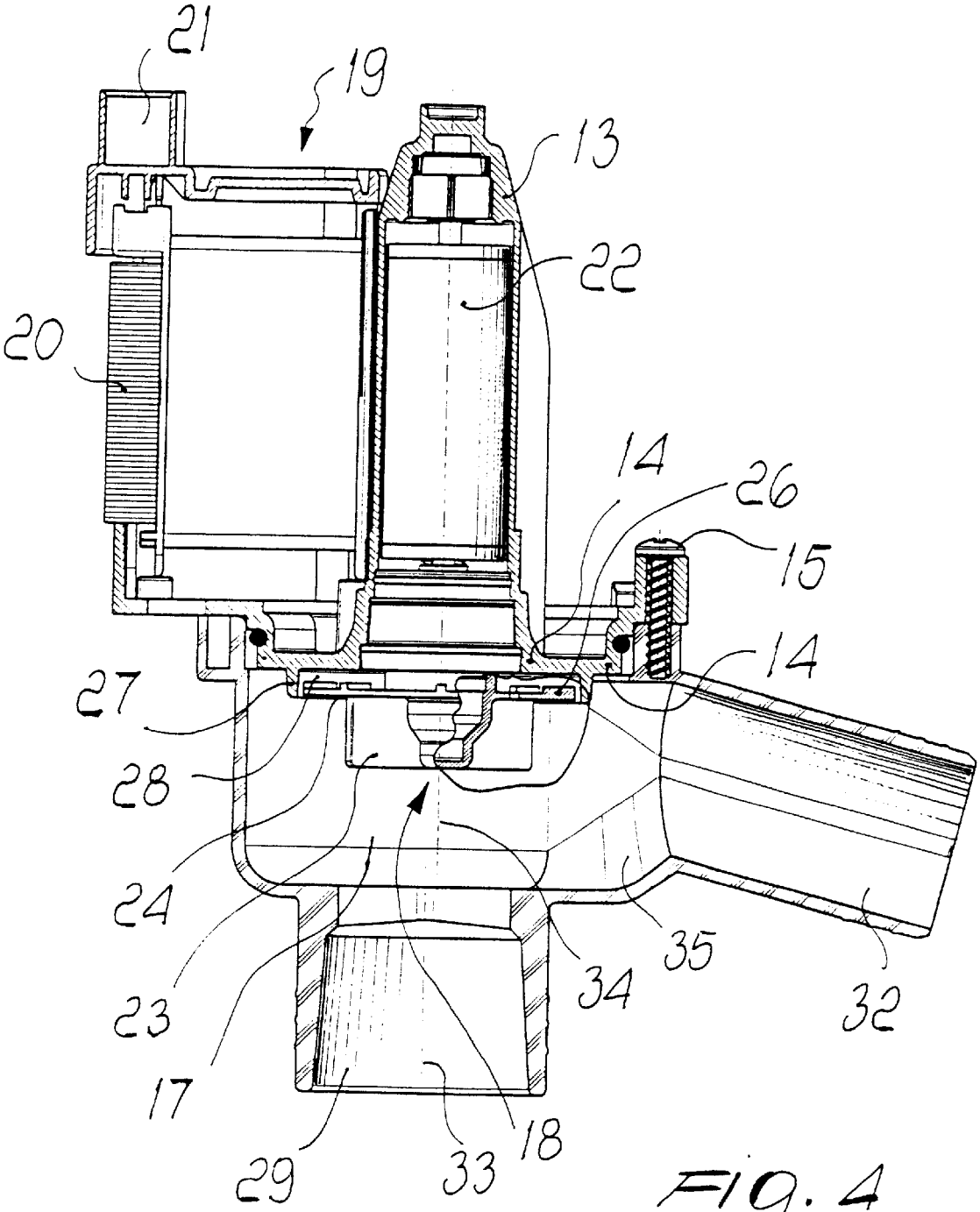
FIG. 4 is a sectional view of the pump, i.e., of the impeller, of its chamber and of the electrical part of the motor.
Figure 5:
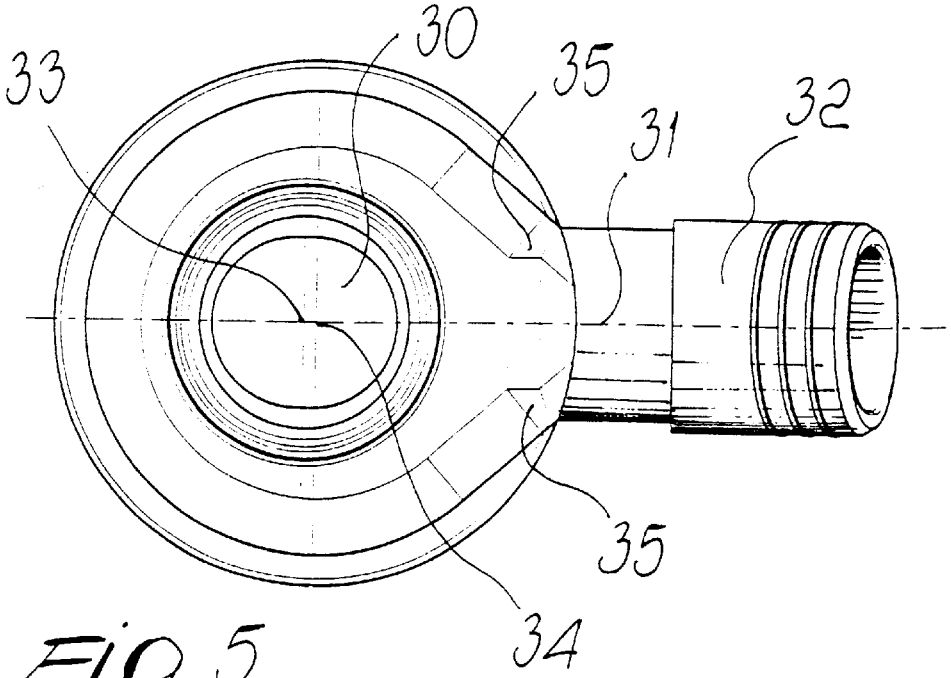
FIG. 5 is a front view of the dome, taken from the side of the intake duct.
Figure 6:
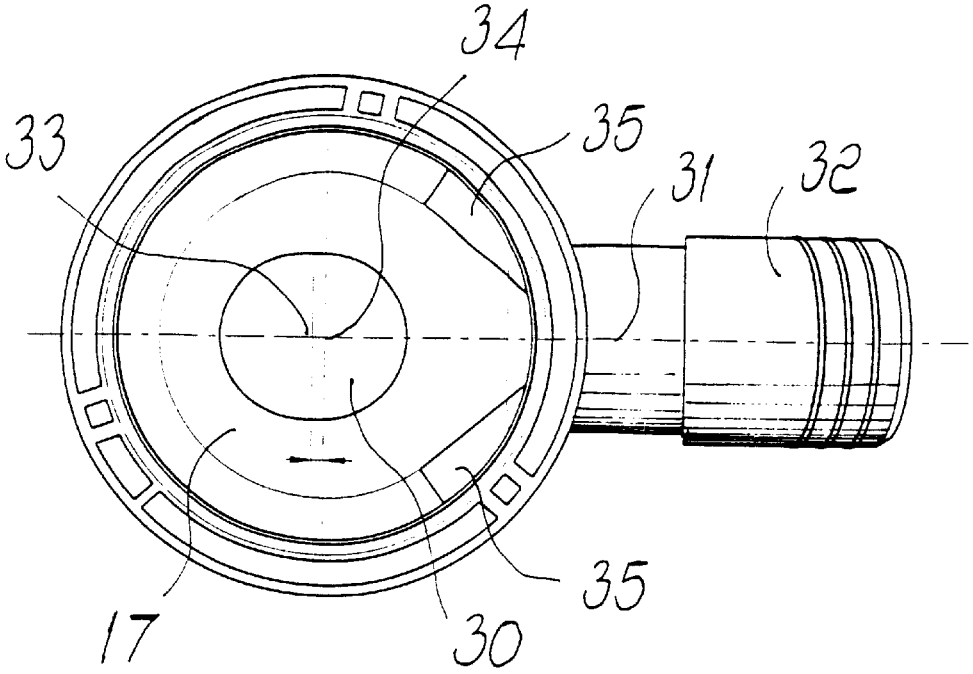
FIG. 6 is a front view of the dome, taken from the side of the impeller chamber.

With reference to the above figures, the pump according to the present invention is generally designated by the reference numeral 10 in FIG. 1, where the reference numeral 11 designates an electrical part and the reference numeral 12 designates an hydraulic part.

In the electrical part, which is of a per se known type, a rotor chamber 13 is monolithic with a coupling flange 14 which is associated, by means of is screws 15, with a dome 16 which forms a chamber 17 in which an impeller 18 rotates. The impeller 18 and the dome 16 make up the hydraulic part 12.

The electrical part 11 also shows stator windings 19 that surround a stator pack 20 and are connected to two electrical terminals 21 for supplying them with power.

The impeller 18 associated with a shaft of a rotor 22, of the permanent-magnet type, has radial vanes 23 which protrude orthogonally from the surface of a disk 24 which has a plurality of through holes 25.

The face of the disk 24 of the impeller 18 that is directed toward the chamber 13 of the rotor 22 has a plurality of radial compensation vanes 26.

An annular raised portion 27, formed in the coupling flange 14, forms a region 28 for containing the part of the impeller 18 that is constituted by the disk 24 with the compensation vanes 26.

This particular embodiment of the impeller 18 is designed to solve two problems that occur in conventional drain outlet pumps for washing machines.

As it turns, the pump produces, inside the chamber 17, a distribution of pressures by way of which the impeller 18 is subjected to a force in the direction of an intake duct 29.

In order to compensate for this situation, which is negative because it would tend to move the impeller 18 away from the coupling flange 14, a negative pressure is produced, by means of the compensation vanes 26, in the region 28, balancing the pressure distribution.

This balancing is also assisted by the holes 25, which allow water to flow on the two sides of the disk 24, so as to produce the same pressure on both sides.

The chamber of the impeller 17, as shown in the figures, is very large in order to allow even bulky objects to pass without jamming between the impeller 18 and the internal walls of the chamber 17.

In order to achieve an improved situation, indeed because of these problems, it has been observed that it is convenient for the cross-section of an intake port 30 to be elliptical, with the major axis of the ellipse arranged so as to coincide with the axis 31 of the discharge duct 32.

It has also been observed that in order to achieve an optimum situation as regards foam, in addition to the elliptical shape of the port 30 it is convenient for a center 33 of the ellipse to be axially offset with respect to a geometric axis 34 of the impeller 18.

The center of the impeller 18, determined by its axis 34, must be interposed between the center of the ellipse 33 and the discharge duct 32.

In order to facilitate the exit of foreign objects and to better convey the foam when there is a lot of foam, in the dome 16, which forms the chamber 17 of the impeller 18, there are radiused regions 35 for the discharge duct 32, which also has an elliptical cross-section.

The radiused regions 35 act as guides for the water flow and therefore also for any objects entrained therein.

In summary, the improvements introduced with this new type of pump allow to minimize the danger of blockage of the pump due to foreign objects, in addition to allowing the pumping of water even in the presence of considerable amounts of foam.

Moreover, compensation of the pressure on the impeller and the presence of the disk with radial compensation vanes provided on the face of the impeller that lies opposite the one provided with the radial set of vanes prevents foreign objects, even string-like ones, from coiling around the motor shaft that actuates the impeller.

The pump according to the present invention is particularly adapted for use in washing machines typically used in countries in which the mains electricity has a frequency of 60 Hz, which produces a steady-state rotation rate of 3600 rpm for a two-pole permanent-magnet synchronous motor.

It is known that the higher the speed, the greater the problem of cavitation, which is further worsened in the presence of foam.

The large size of the impeller chamber, which leaves considerable radiusing space between the intake duct and the discharge duct, allows even large products and objects, which may accidentally be placed in the washing drum, to pass through.

Pumps having similar characteristics and different dimensions may of course be provided starting from the same inventive concept according to requirements.

The materials used may be any without thereby abandoning the scope of the inventive concept.

The disclosures in Italian Patent Application No. PD99A000050 from which this application claims priority are incorporated herein by reference.

What is claimed is:

1. A pump for the drain outlet of washing machines, comprising a synchronous electric motor with a permanent-magnet rotor which is associated, by means of a flange, with a dome which forms a chamber for an impeller, further comprising an impeller with radial vanes which protrude from a perforated disk provided with a plurality of pressure-compensating vanes on a motor side of the disk, a dome which forms the chamber of the impeller, an intake duct which has an elliptical cross-section with a median axis which is parallel to an axis of the impeller but is axially offset on an opposite side with respect to a discharge duct, said discharge duct having an elliptical cross-section, with a radiused inlet which has the local internal configuration of said dome.

2. The pump according to claim 1, wherein the radial vanes of the disk of the impeller protrude from a face of the disk directed toward the chamber of the impeller, said disk having, on an opposite face, on a side of a rotor of the motor, a plurality of radial pressure-compensating vanes, through holes being further provided in said disk, said holes connecting the chamber of the impeller with a region where said compensation vanes are arranged.

3. The pump according to claim 1, wherein said dome determines the shape and breadth of the impeller chamber, said flange being rigidly coupled to a rotor chamber of the electric motor that drives the impeller, said dome having dimensions adapted to define spaces between the impeller, the water intake duct and the water discharge duct, said spaces letting also large foreign bodies pass through.

4. The pump according to claim 1, wherein said water intake duct has an elliptical shape in which a major axis is parallel to the median axis of the discharge duct.

5. The pump according to claim 4, wherein a geometric center of the elliptical water inlet duct is axially offset with respect to the axis of the impeller and is arranged on an opposite side with respect to the water discharge duct.

6. The pump according to claim 1, wherein the impeller chamber has radiused regions in order to convey the water flow and the objects entrained therein toward the water discharge duct.

* * * * *